US006533027B2

(12) United States Patent
Gille et al.

(10) Patent No.: US 6,533,027 B2
(45) Date of Patent: Mar. 18, 2003

(54) DEVICE FOR ASSEMBLING AT LEAST ONE ITEM OF EQUIPMENT ONTO A HEAT EXCHANGER

(75) Inventors: Gérard Gille, Paray Vieille Poste (FR); Carlos Martins, Montfort l'Amaury (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/911,876

(22) Filed: Jul. 25, 2001

(65) Prior Publication Data

US 2002/0029866 A1 Mar. 14, 2002

(30) Foreign Application Priority Data

Jul. 28, 2000 (FR) ..... 00 09994

(51) Int. Cl.[7] ..... F28F 9/007
(52) U.S. Cl. ..... 165/67; 165/140; 165/178
(58) Field of Search ..... 165/67, 140, 178; 123/41.51; 180/68.4

(56) References Cited

U.S. PATENT DOCUMENTS

| | | | | | |
|---|---|---|---|---|---|
| 4,465,124 | A | * | 8/1984 | Jacquet et al. | 165/67 |
| 5,069,275 | A | * | 12/1991 | Suzuki et al. | 165/67 |
| 5,163,505 | A | * | 11/1992 | Hoffman et al. | 165/67 |
| 5,197,538 | A | | 3/1993 | Nagasaka et al. | |
| 5,205,349 | A | * | 4/1993 | Nagao et al. | 165/67 |
| 5,429,181 | A | * | 7/1995 | Tordjeman | 165/67 |
| 5,487,422 | A | * | 1/1996 | Bertva et al. | 165/67 |
| 5,685,364 | A | * | 11/1997 | Harris | 165/67 |
| 5,934,365 | A | * | 8/1999 | Rhodes et al. | 165/173 |
| 6,263,954 | B1 | * | 7/2001 | Nakayama | 165/67 |

FOREIGN PATENT DOCUMENTS

| | | | | |
|---|---|---|---|---|
| DE | 198 57 494 A | | 7/1999 | |
| DE | 198 57 512 A | | 7/1999 | |
| EP | 0516413 A1 | | 12/1992 | |
| JP | 3-70994 | * | 3/1991 | 165/67 |
| JP | 07004783 | | 1/1995 | |
| JP | 11125479 | | 5/1999 | |

* cited by examiner

*Primary Examiner*—Leonard Leo
(74) *Attorney, Agent, or Firm*—Liniak, Berenato & White

(57) ABSTRACT

The invention relates to a device for assembling at least one item of equipment, such as a secondary heat exchanger, onto a primary heat exchanger, the said primary heat exchanger including a tube manifold (8) and a manifold chamber (9) crimped onto the tube manifold, the periphery of the said tube manifold forming a groove (12) for accommodating a sealing gasket (13) between the tube manifold and the manifold chamber. This device comprises, on the one hand, first means (19, 21, 23) for clipping onto the outside of the said groove, and, on the other hand, means (20) for accommodating and locking the said item of equipment. Application to motor vehicles.

7 Claims, 7 Drawing Sheets

DEVICE FOR ASSEMBLING AT LEAST ONE ITEM OF EQUIPMENT ONTO A HEAT EXCHANGER

FIELD OF THE INVENTION

The invention relates to a device for assembling at least one item of equipment, such as a secondary heat exchanger, onto a primary heat exchanger, especially of a motor vehicle.

BACKGROUND OF THE INVENTION

More particularly, it relates to such a device capable of being used when the said primary heat exchanger includes a tube manifold and a manifold chamber crimped onto the tube manifold, the periphery of the said tube manifold forming a groove for accommodating a sealing gasket between the tube manifold and the manifold chamber.

It is known to assemble one or more items of equipment onto a heat exchanger, such as a radiator for cooling a motor-vehicle engine, so as to constitute an assembly, also called module ready to be installed into the vehicle. One of these items of equipment may, for example, be a secondary heat exchanger, in particular a cooler of air for supercharging of the engine, an air-conditioning condenser or an oil cooler. Another item of equipment may, for example, be a fan shroud.

The assembling of these items of equipment onto the exchanger is generally achieved by way of lugs integral with the equipment and of screws inserted into the manifold chambers of the main exchanger. Systems for assembling by nesting or clipping of the manifold assemblies have also been proposed, in the case of two heat exchangers.

These known assembling techniques exhibit the drawback of requiring operations which are expensive in terms of time and of tooling.

The invention aims especially to remedy this drawback.

More particularly, the object of the invention is to provide a heat-exchange module the production of which, and especially the fitting operations, is as simple as possible.

SUMMARY OF THE INVENTION

To that end, the subject of the invention is first of all a device for assembling at least one item of equipment, such as a secondary heat exchanger, onto a primary heat exchanger, especially or a motor vehicle, the said primary heat exchanger including a tube manifold and a manifold chamber crimped onto the tube manifold, the periphery of the said tube manifold forming a groove for accommodating a sealing gasket between the tube manifold and the manifold chamber, the device comprising, on the one hand, first means for clipping onto the outside of the said groove, and, on the other hand, means for accommodating and locking the said item of equipment.

The fitting of the equipment onto the heat exchanger can thus be limited to simple clipping operations. This results in a simplification of the fitting of the heat-exchange module.

The crimping of the manifold chamber onto the tube manifold usually takes place by the use of teeth projecting from the edge of the groove, folded over onto a shoulder of the manifold chamber. In this case, the said first clipping means may comprise a set of lugs configured to bear on the outer surface of the groove, and at least one abutment configured to clip onto the edge of the groover between the projecting teeth, In a first particular embodiment, the said accommodating and locking means comprise second clipping means complementary with an element of the said equipment.

In this case, and when the item of equipment to be assembled is a secondary heat exchanger, the said second clipping means may be complementary with a manifold chamber of the said secondary heat exchanger.

In a second particular embodiment, the said accommodating and locking means comprise a projecting part including cut-outs for accommodating fluid-circulation tubes of the secondary heat exchanger.

In this case, the said accommodating and locking means may comprise a locking hook which can be clipped onto a cheek of the said secondary heat exchanger.

A further subject of the invention is a heat-exchange module, especially of a motor vehicle, comprising a primary heal exchanger and at least one item of equipment, such as a secondary heat exchanger, in which the said item of equipment is assembled onto the said primary heat exchanger by the use of at least one device as described above.

BRIEF DESCRIPTION OF THE DRAWINGS

Two particular embodiments of the invention will now be described, by way of non-limiting example, by reference to the attached diagrammatic drawings in which.

DESCRIPTION OF THE PREFERRED EMBODIMENTS

Figure 1:
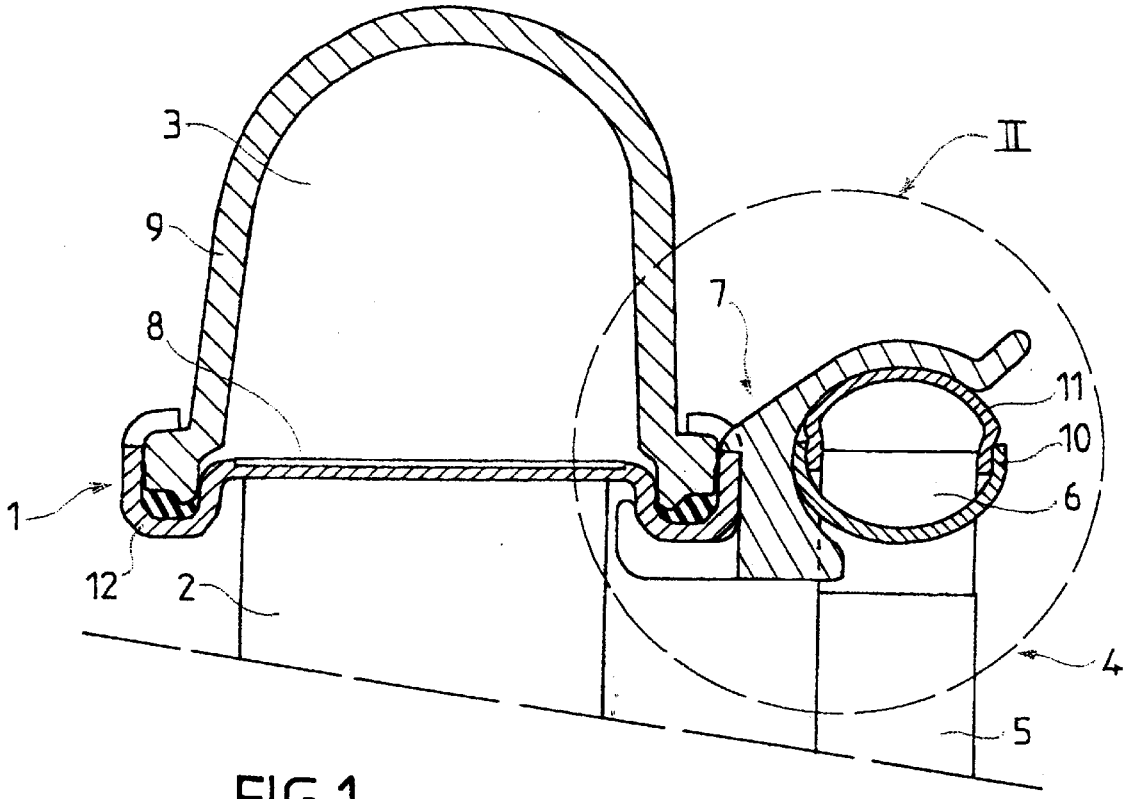
FIG. 1 is a partial view in section at a first embodiment of the invention.
Figure 2:
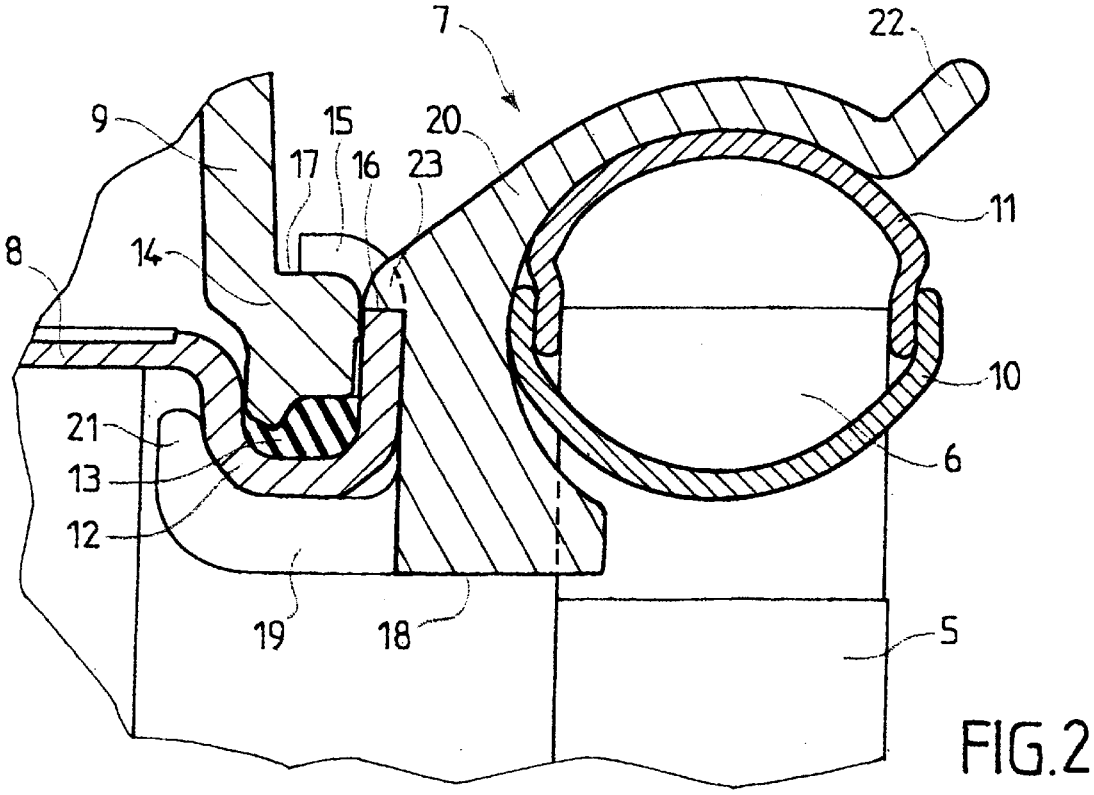
FIG. 2 is a view on a larger scale of the detail II of FIG. 1.
Figure 3:
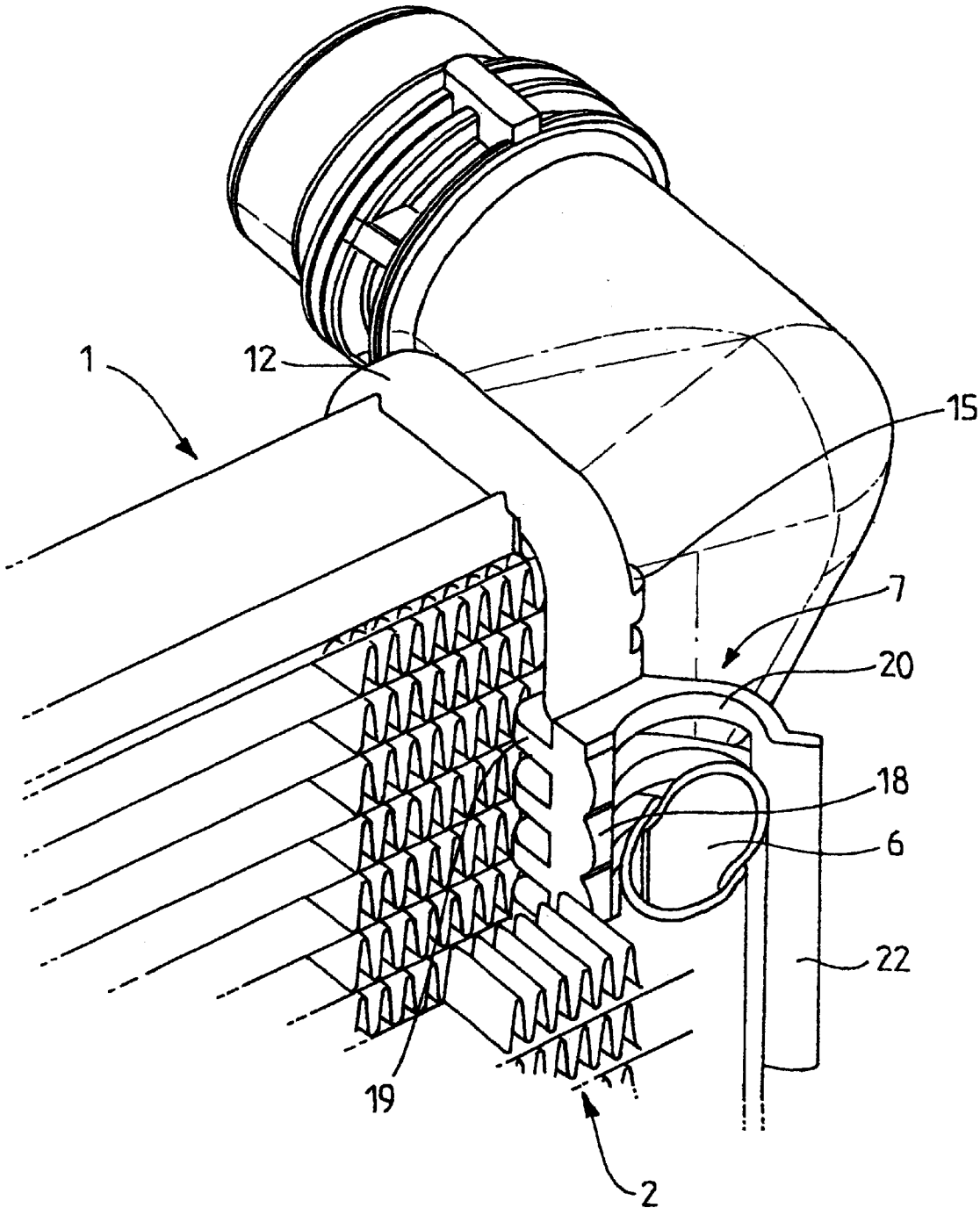
FIG. 3 is a partial view in cut-away perspective of this first embodiment.
Figure 4:
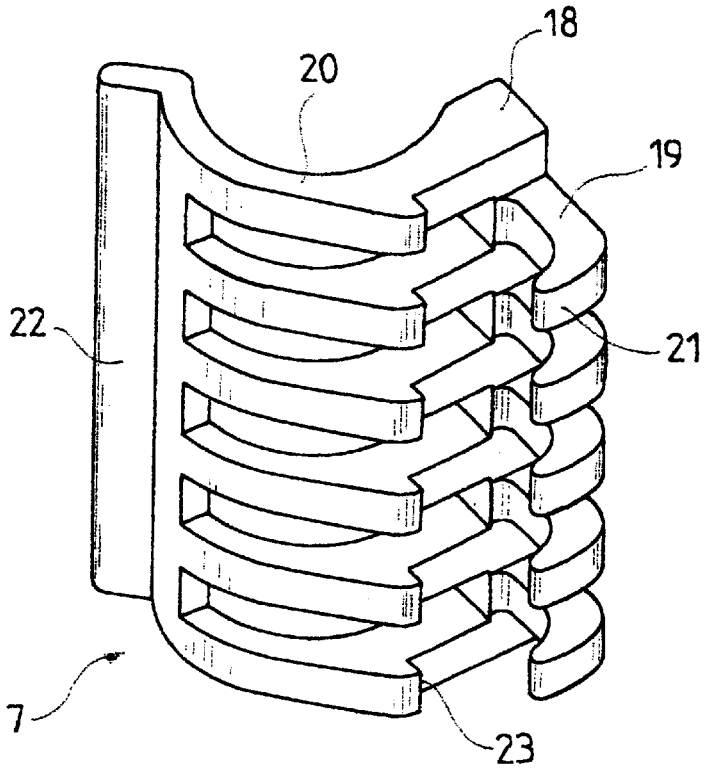
FIGS. 4 and 5 are partial views in perspective of the assembling device used.
Figure 5:
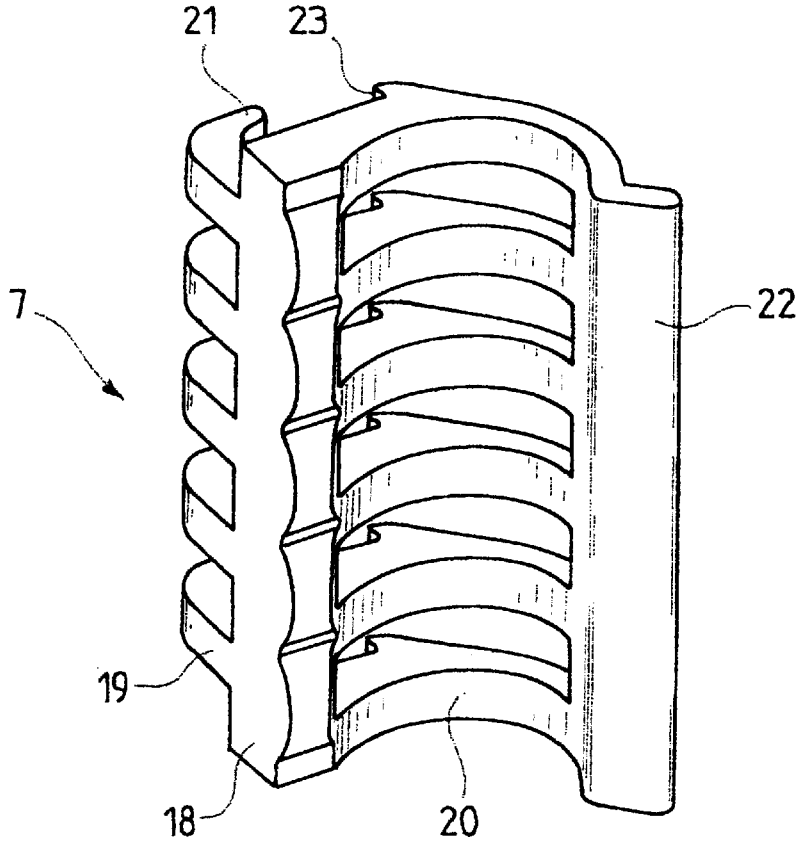

In FIG. 1 is seen a primary heat exchanger 1 with its bank of tubes 2 and one of its manifold assemblies 3, as well as a secondary heat exchanger 4 with its bank of tubes 5 and one of its manifold assemblies 6. The two heat exchangers are assembled by means of an assembling device 7 on the side represented, and, in any suitable way, possibly by a device of the same type, on the side not represented.

The manifold assembly 3 consists, in essence, of a tube manifold 8 which receives the ends of the tubes of the bank, 2, and of a manifold chamber 9 crimped onto the tube manifold 8.

The manifold assembly 6 is substantially cylindrical and consists, in essence, of two U-shaped profiled sections, one of which, 10, receives the ends of the tubes of the bank 5 and the other of which, 11, is brazed onto the first one.

The edges of the tube manifold 8 form a groove 12 in which a sealing gasket 13 is arranged. The edges of the manifold chamber 9 form a sealing bead 14 engaged in the groove 12 and bearing on the seal 13.

The crimping of the manifold chamber 9 onto the tube manifold 8 is achieved by a set of teeth 15 projecting from the edge 16 of the groove 12. The teeth 15 are curved over and come to bear on a shoulder 17 of the manifold chamber 9.

The assembling device 7 is produced from relatively springy plastic in order to allow the clipping operations. It comprises an elongate body 18 along which alternately project a first set of lugs 19 on the side by which it is mounted onto the heat exchanger 1, and a second set of lugs 20 on the side on which the exchanger 4 is assembled. The lugs 19 include a curved jaw 21 at their ends, and the lugs 20 together support a generally flat, continuous profile 22, at their end. The profile 22 is turned towards the outside of the concavity of the lugs 20.

The cross section of the concave side of the lugs 19 and of the jaws 21 corresponds to the outer cross section of the groove 12, and the cross section of the concave side of the lugs 20 corresponds to the outer cross section of the manifold assembly 6. The concavities of the lugs 19 and 20 are turned in opposite directions.

Each lug 20 furthermore supports an abutment 23, on its convex side, the set of abutments 23 facing the set of jaws 21. The distance from the abutments 23 to the lugs 19 is substantially equal to the outer depth of the groove 12.

The assembling of the two exchangers is carried out by first of all clipping the assembling device 7 onto the groove 12 of the exchanger 1. The lugs 20 and the jaws 21 then come to surround the groove 12, while the abutments 23 come to bear on the edge 16 of the groove 12, between the teeth 15. The lugs 20 and the profile 22 then project from the side opposite the exchanger 1.

The exchanger 4 is then clipped onto the lugs 20. This clipping is facilitated by the profile 22 which causes the lugs 20 to move apart when the manifold assembly a is supported Once the clipping has been carried out, the lugs 20 hold the exchanger 4 by clamping the manifold assembly 6.

The embodiment of FIGS. 6 to 9 will now be described, in which the same references as in FIGS. 1 to 5 have been used to designate corresponding elements.

Figure 6:
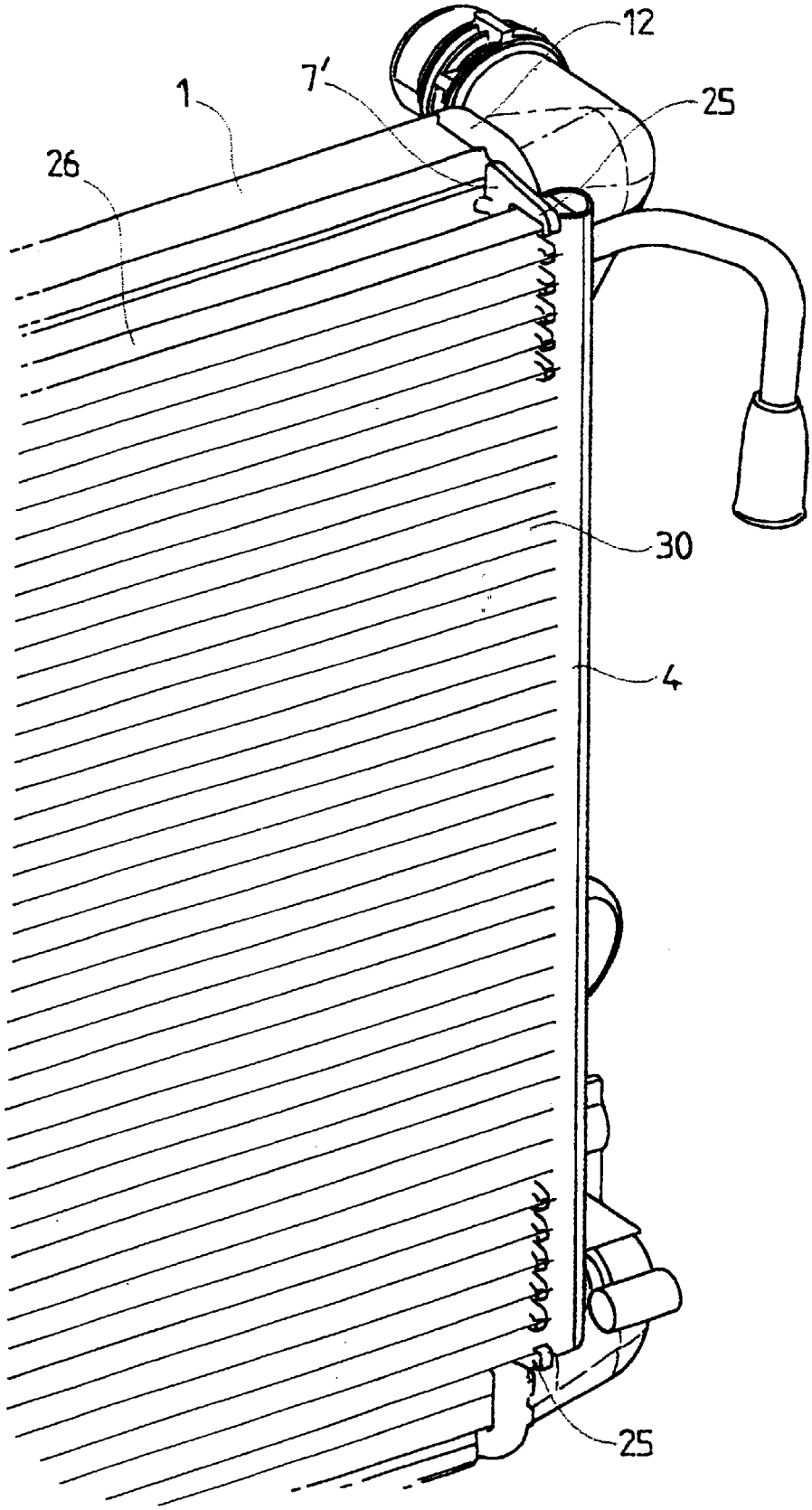
FIG. 6 is a partial view in perspective of a second embodiment of the invention.

The primary exchanger 1 is seen in FIG. 6, assembled to the secondary exchanger 4 by means of an assembling device 7'.

Figure 7:
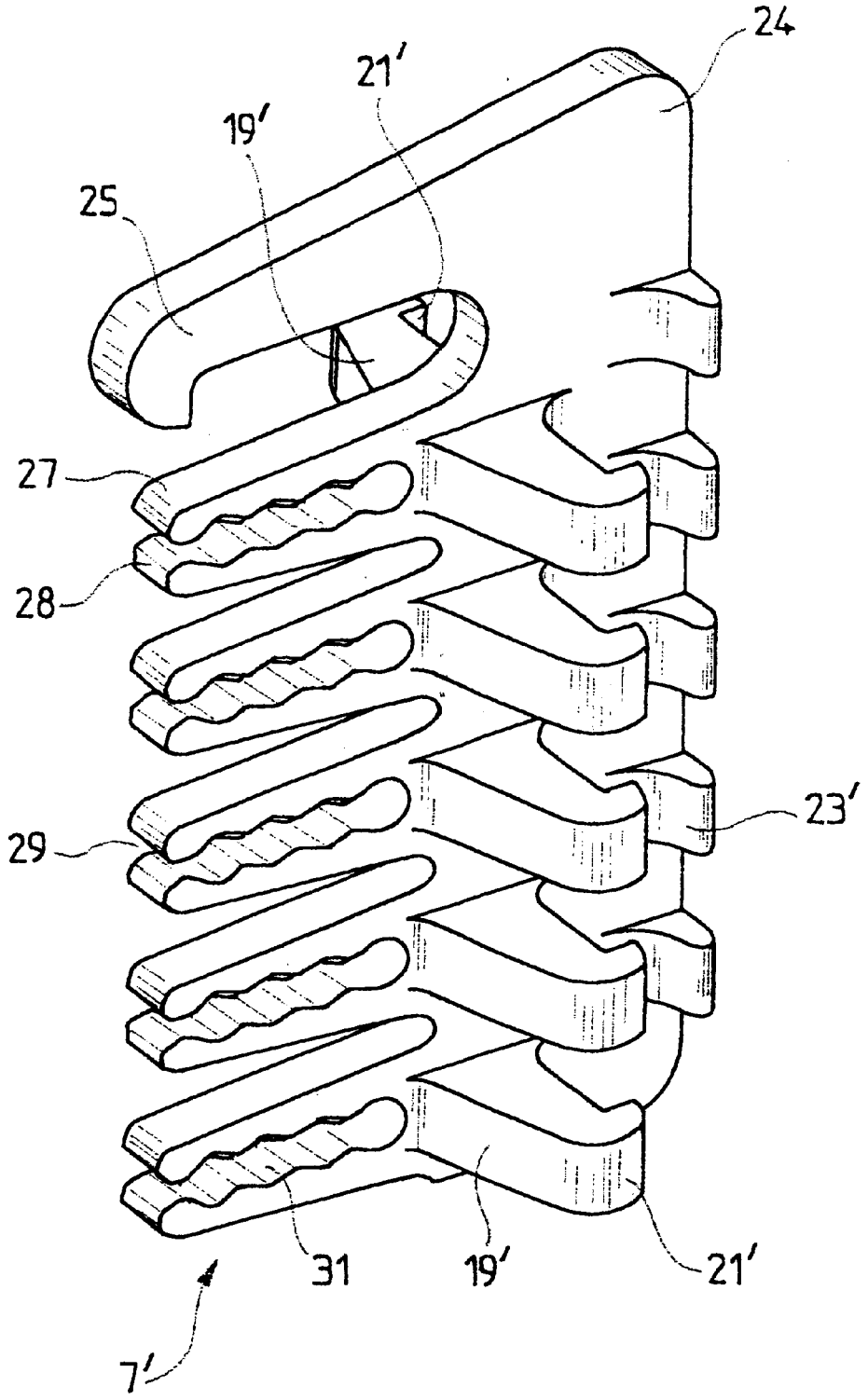
FIG. 7 is a partial view in perspective of the assembling device used in this second embodiment.
Figure 8:
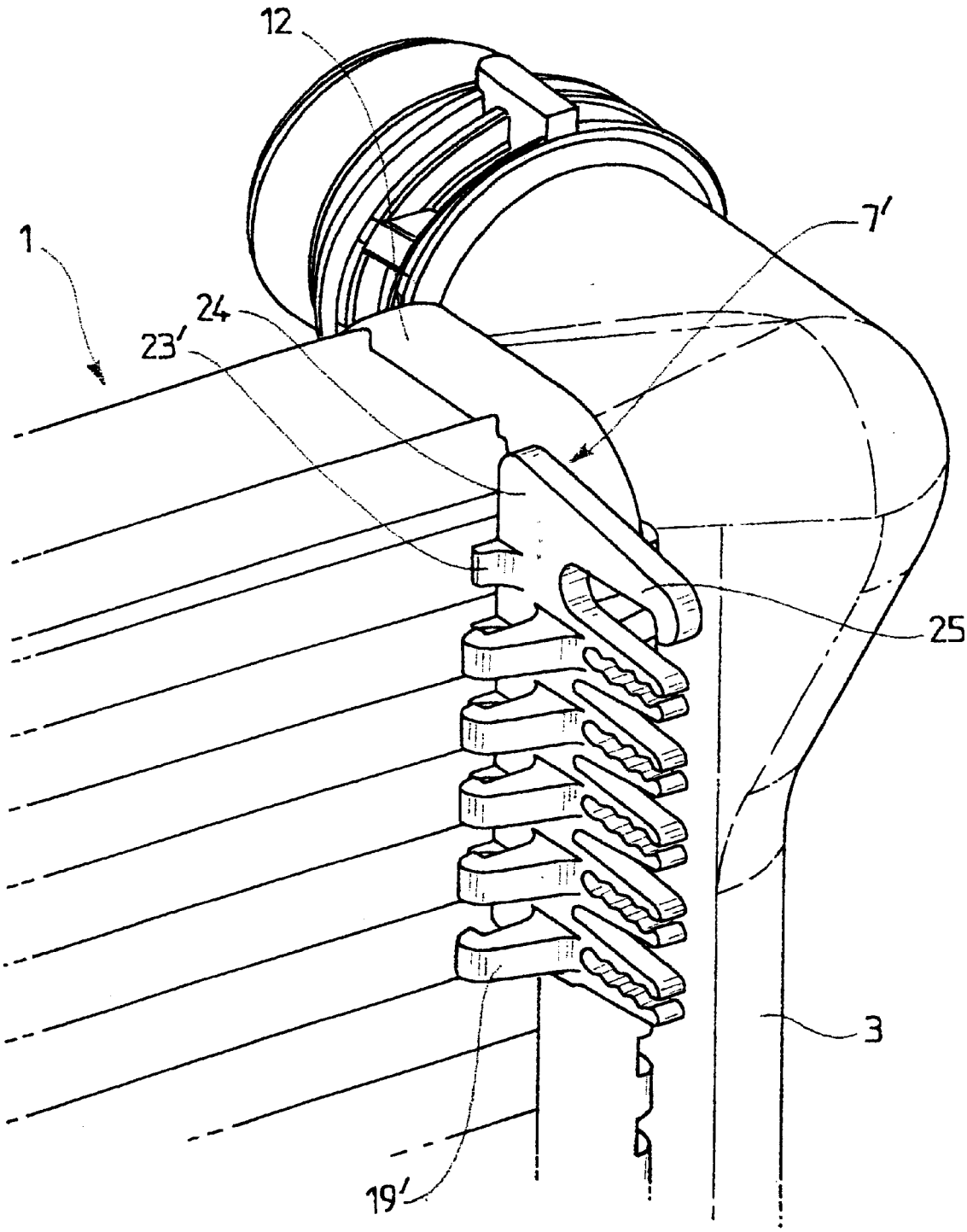
FIGS. 8 and 9 are views in perspective of this second embodiment before the secondary heat exchanger is fitted.
Figure 9:
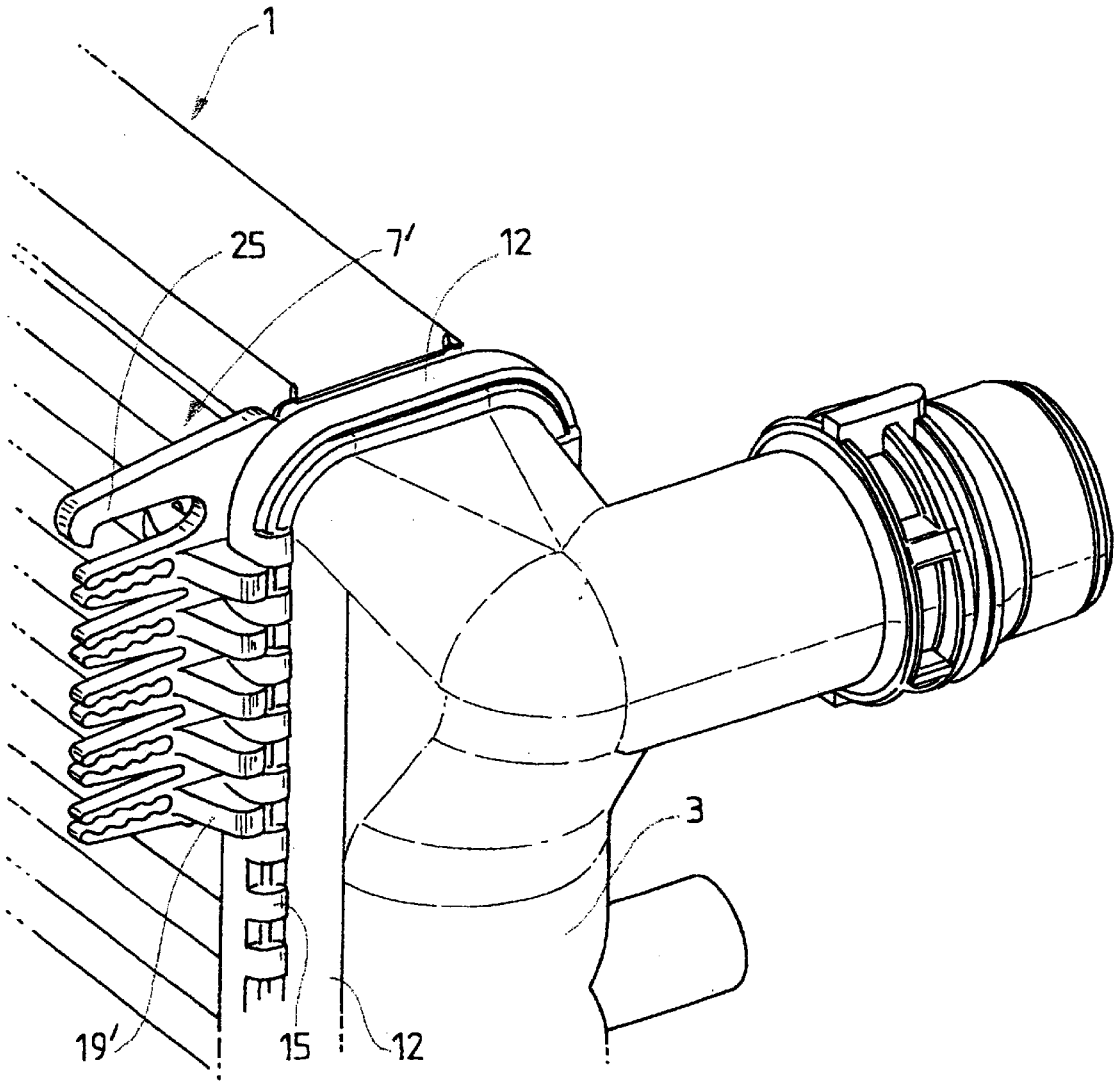

The device 7', represented in detail in FIG. 7, is produced from relatively springy plastic and includes a body, consisting of an elongate flat plate 24, and a set of fixing appendages produced in a single piece with the body.

One of the long sides of the plate 24, at each of its ends, forms a clipping hook 25 of a complementary shape to that of the cheeks 26 of the exchanger 4 in order for each of them to clip onto one of these cheeks. Between the two hooks 26 is formed a set of pairs of teeth 27 and 28.

Each pair of teeth 27, 28 delimits a space 29 capable of receiving one of the tubes 30 of the exchanger 4, and the pairs of teeth are spaced by a distance equal to the pitch of the tubes 30. Each tooth of a pair of teeth, face-to-face with the other tooth of the same pair, carries corrugations 31 making it possible to hold one tube 30.

On each of its faces, and on the side opposite the teeth 28, 29, the plate 24 carries a set of lugs 19' equipped with jaws 21', and a set or abutments 23', these two sets alternating and facing each other. In fact, the lugs 19', the jaws 21' and the abutments 23' have the same shaping and the same relative arrangement as the lugs 19, the jaws 21 and the abutments 23 of the first embodiment, so as to be able to be clipped onto the groove 12 of the exchanger 1.

The exchangers 1 and 4 are assembled, in the present case, in the following way.

The device 7' is first of all clipped onto the groove 12 as in the first embodiment. It will be observed that the device 7' is substantially symmetric with respect to the plane of the plate 24 so as to be able to be mounted in either one direction or the other, at one or other end of the exchanger 1.

The exchanger 4 is then mounted onto the assembling device 7'. To that end, the tubes 30 of the exchanger 4 are inserted into the spaces 29 and, simultaneously, the hooks 25 are clipped onto the cheeks 26 of the exchanger 4.

The invention thus makes it possible to assemble the exchanger 4, or any other item of equipment, onto the exchanger 1, simply by clipping.

The assembling is preferably done by the use of four devices mounted two by two on opposite sides of the collector of the primary exchanger. However, it is possible to carry out the assembling with two devices mounted respectively on these two opposite sides.

The device is preferably separate from the item of equipment. However, it can be envisaged, in certain cases, producing the device in a single piece with the equipment, for example by moulding from a plastic.

The assembling of an item of equipment onto one face of the primary exchanger has been described, but, clearly, two items of equipment could each be assembled in the same way on one face of the primary exchanger.

What is claimed is:

1. Device for assembling at least one item of equipment (4) onto a primary heat exchanger (1) of a motor vehicle, said primary heat exchanger including a tube manifold (8) and a manifold chamber (9) crimped onto the tube manifold, the periphery of said tube manifold forming a substantially u-shaped groove (12) for accommodating a sealing gasket (13) between the tube manifold and the manifold chamber, said device comprising, on the one hand, first clipping means (19, 21, 23; 19', 21', 23') for clipping onto an outside of said groove, and, on the other hand, accommodating and locking means (20; 25, 27, 28) for accommodating and locking said item of equipment, wherein said first clipping means defines a substantially u-shaped configuration, and wherein both said u-shaped groove (12) and said u-shaped configuration of the first clipping means have an open end that faces toward said manifold chamber.

2. Device according to claim 1, for assembling said item of equipment onto a primary heat exchanger in which an edge of said groove (12) includes projecting teeth (15) folded over onto a shoulder (17) of said manifold chamber, and in which said first clipping means comprise a set of lugs (19) configured to bear on the outer surface of the groove, and at least one abutment (23) configured to clip onto the edge (16) of the groove, between the projecting teeth.

3. Device according to claim 1, in which said accommodating and locking means comprise second clipping means (20), complementary with an element of said item of equipment.

4. Device according to claim 3, for assembling at least one secondary heat exchanger (4) onto the said primary heat exchanger, and in which said second clipping means (20) are complementary with a manifold chamber (6) of the said secondary heat exchanger.

5. Device according to claim 1, for assembling at least one secondary heat exchanger (4) onto the said primary heat exchanger, and in which said accommodating and locking means comprise a projecting part (24) including cut-outs (29) for receiving fluid-circulation tubes (30) of the secondary heat exchanger.

6. Device according to claim 5, in which said accommodating and locking means comprise a locking hook (25) which can be clipped onto a cheek (26) of said secondary heat exchanger.

7. Heat-exchange module of a motor vehicle, comprising a primary heat exchanger (1) and at least one item of equipment (4), wherein said item of equipment is assembled onto the said primary heat exchanger by the use of at least one device according to claim 1.

* * * * *